United States Patent [19]

Hydorn

[11] 3,999,656

[45] Dec. 28, 1976

[54] PLASTIC SUIT BAG

[76] Inventor: Dennis Harley Hydorn, 12 Sheppard St. (4th Floor), Toronto, Ontario, Canada

[22] Filed: Oct. 21, 1975

[21] Appl. No.: 624,451

[52] U.S. Cl. ..... 206/279; 206/282; 206/284; 206/287

[51] Int. Cl.[2] ..... B65D 85/18

[58] Field of Search ..... 206/279, 278, 282, 283, 206/284, 286, 287, 288

[56] References Cited

UNITED STATES PATENTS

| | | | |
|---|---|---|---|
| 1,900,814 | 3/1933 | Holley | 206/287 |
| 1,912,311 | 5/1933 | Saulnier | 206/282 |
| 2,186,209 | 1/1940 | Roth | 206/282 |
| 2,270,547 | 1/1942 | Nichols | 206/282 |
| 2,562,444 | 7/1951 | Beer | 206/279 |
| 2,606,636 | 8/1952 | Braverman | 206/279 |
| 2,874,827 | 2/1959 | Neely | 206/287 |
| 3,687,277 | 8/1972 | Spencer | 206/284 |
| 3,744,600 | 7/1973 | Belland | 206/279 |

*Primary Examiner*—R. E. Hart

[57] ABSTRACT

A suit bag comprises a bag portion of plastic film having a handle secured at each end of the bag. The sole means of entering the suit bag is provided by a slit or opening which extends between the ends of the bag. The handle is of plastic and has a hand grip portion integrally molded with a bar portion. A hook for hanging a suit is integrally molded with an edge of the bar portion opposite the hand grip portion. The bar portion of each handle is thermally welded to the respective bag end. The hand grip portion is exterior of the bag and is centrally located at the bag's end. The handles have fastening means exterior of the bag which mate with one another to secure the pair of handles together in face-to-face relationship with the hand grip portions aligned. With the handles fastened together, the bag is folded centrally of its length. The bag may be provided with means for closing the slit or opening of the bag.

20 Claims, 14 Drawing Figures

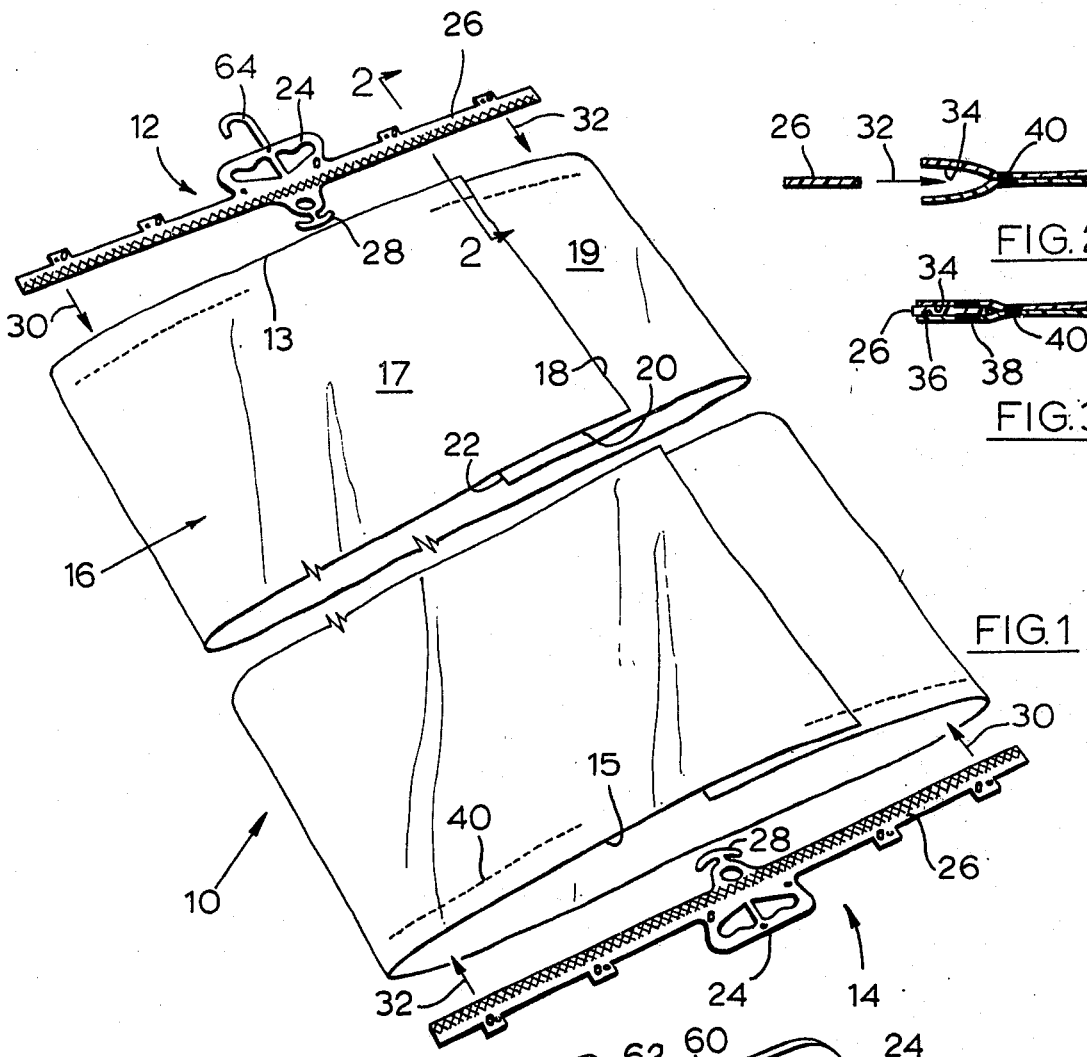
FIG. 1
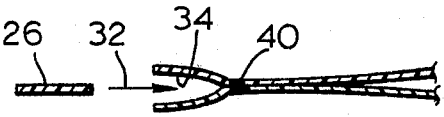
FIG. 2
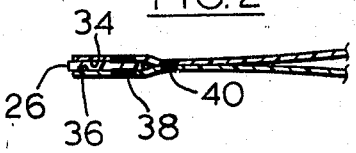
FIG. 3
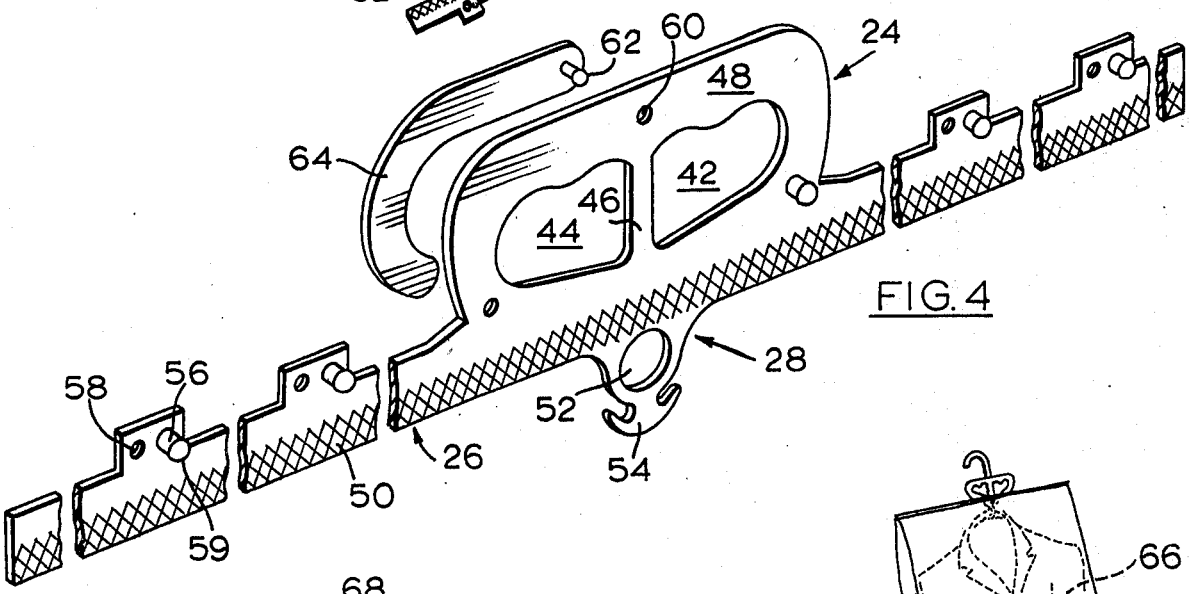
FIG. 4
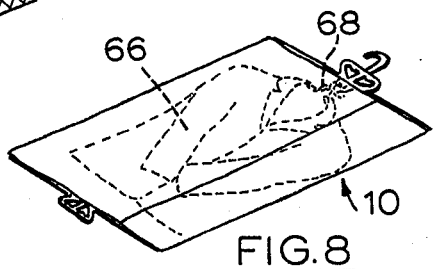
FIG. 8
FIG. 9
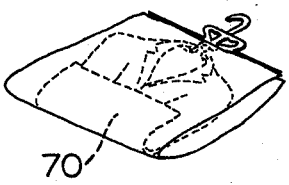
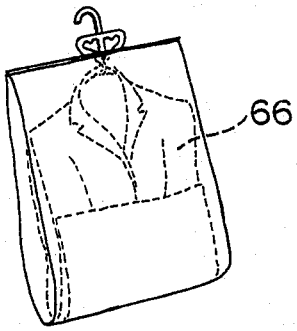
FIG. 10

FIG. 5
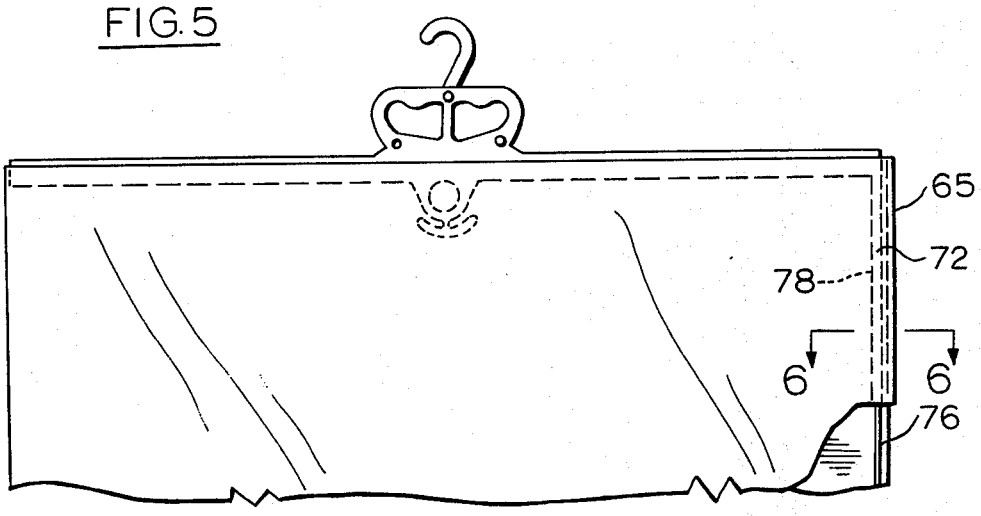
FIG. 6
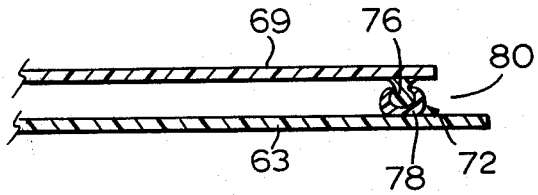
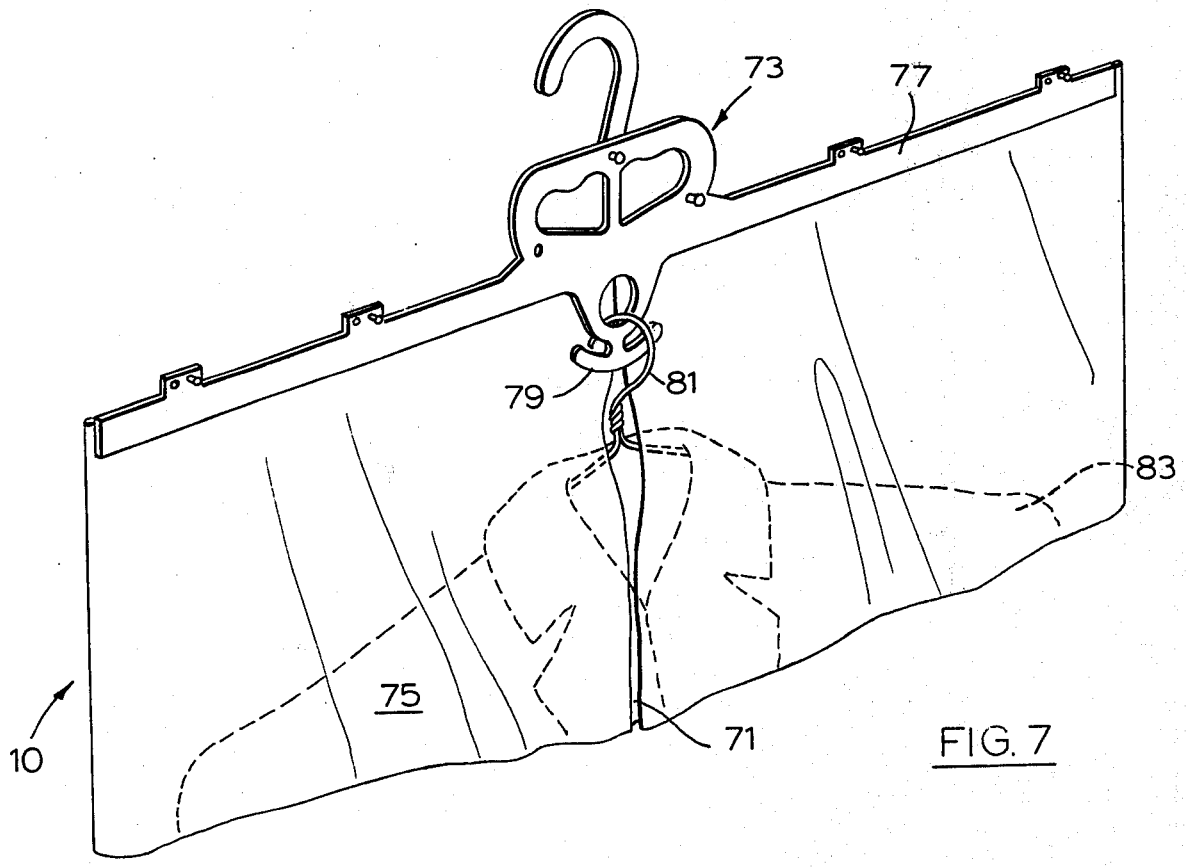
FIG. 7

PLASTIC SUIT BAG

FIELD OF THE INVENTION

This invention relates to a plastic suit bag having handles at each end of its bag portion where the sole means of entry into the bag is provided by an opening which extends between the ends of the bag, the bag being folded upon itself and the handles fastened together for purposes of transporting goods within the suit bag.

BACKGROUND OF THE INVENTION

The well known suit bag often used by retailers comprises a bag portion with a hole in the top through which a hanger hook projects. Entry into the bag is permitted through a zippered opening in the front of the bag. The suit or pants are hung on the hanger in the bag with the hanger hook projecting out of the bag and the zipper closed. This type of suit bag is awkward to carry since the bag cannot be folded upon itself and maintained in that position while being carried.

An alternate form of suit bag is a tubular bag with both ends open where two handles are provided at each end of the bag. The handles are detachably secured together to close off each end of the bag and can be pulled apart to permit entry into the bag through either end. When the goods are placed in the bag, the handle sets are closed and the bag folded upon itself for carrying. This type of bag is more easily carried; however, it is very difficult to load a suit into this bag because entry into the bag is only provided at the bag ends.

It is therefore an object of the invention to provide a plastic suit bag within which a suit may be easily loaded and is easy to carry when the bag is loaded.

It is another object of the invention to provide a suit bag which is inexpensive to manufacture, yet has sufficient structural strength to carry even the heaviest of clothing.

It is a further object of the invention to provide a plastic suit bag within which a suit may be placed without the need for a hanger.

It is another object of the invention to provide a suit bag with handle portions which are identical and which, when fastened together, fold the bag centrally of its length where the clothing within the bag rests in natural folds.

It is yet another object of the invention to provide a suit bag which may be easily loaded by right- or left-handed people.

It is a further object of the invention to provide closure means for closing the opening in the suit bag after the suit bag is loaded with clothing.

SUMMARY OF THE INVENTION

The suit bag according to this invention overcomes the problems associated with the prior art type of suit bags in that it provides a bag which has an opening in its side to permit loading of the bag through its side rather than the ends. Handles are provided at each end of the bag, which, when fastened together cause the bag to fold upon itself and facilitate carrying of the enclosed goods. The plastic suit bag comprises a bag portion of plastic film having a rectangular shaped inner and outer surface with a handle secured at each end of the bag portion. A slit or opening is provided in the bag portion which extends between the ends of the bag to provide the sole means of entry into the suit bag. Each handle is made of plastic and has a hand grip portion integrally molded with a bar portion. Means for hanging a suit by is integrally molded with an edge of the bar portion opposite the hand grip portion. The bar portion of each handle is secured to a respective end of the bag where the hand grip portion is exterior of the bag. The bar portion extends along a major portion of the bag's end length to provide support for the bag end and to essentially close off each bag end if it has not been previously sealed. The two handles have fastening means exterior of the bag and which when mated, secure the pair of handles together in face-to-face relationship with the hand grip portions aligned and with the bag centrally folded of its length. Closure means may be provided on the bag for closing the opening provided in the bag. However, when closure means is not used, the arrangement of the handles on the bag ends is such that as the handles are fastened together, the inner surface of the bag which has the opening therein is folded upon itself so that the opening is not exterior of the bag and is essentially closed to preclude goods falling out of the bag while being carried. As a result, the outer surface of the folded bag which is uninterrupted provides support for the goods carried in the bag.

The slit or opening in the bag may when appropriate, be located off-centre of the means for hanging a suit by to facilitate insertion and removal of a suit or the like into and from the bag portion.

DESCRIPTION OF THE DRAWINGS

These and other objects, advantages and features of the invention will become apparent in the following detailed description of the preferred embodiments of the invention as shown in the drawings, wherein:

FIG. 1 is an exploded view of a suit bag according to a preferred embodiment of this invention prior to its assembly.

FIG. 2 is a section of the bag of FIG. 1 taken along the lines 2—2.

FIG. 3 shows the assembled section of FIG. 2 with the handle bar portion thermally welded to the bag end.

FIG. 4 is an enlarged view of a handle for a suit bag according to this invention.

FIG. 5 shows an upper portion of the suit bag according to this invention having means for closing the opening in the bag.

FIG. 6 shows an alternate embodiment of the means for closing the opening of the bag of FIG. 5.

FIG. 7 shows an alternative embodiment according to the invention with the handle thermally welded to the inner surface of the bag.

FIGS. 8, 9 and 10 appearing on the same sheet as FIG. 1 show the sequence of steps of placing a suit within a bag according to this invention without the need for a hanger.

DETAILED DESCRIPTION OF THE PREFERRED EMBODIMENTS

Figures 11, 12, 13, 14:
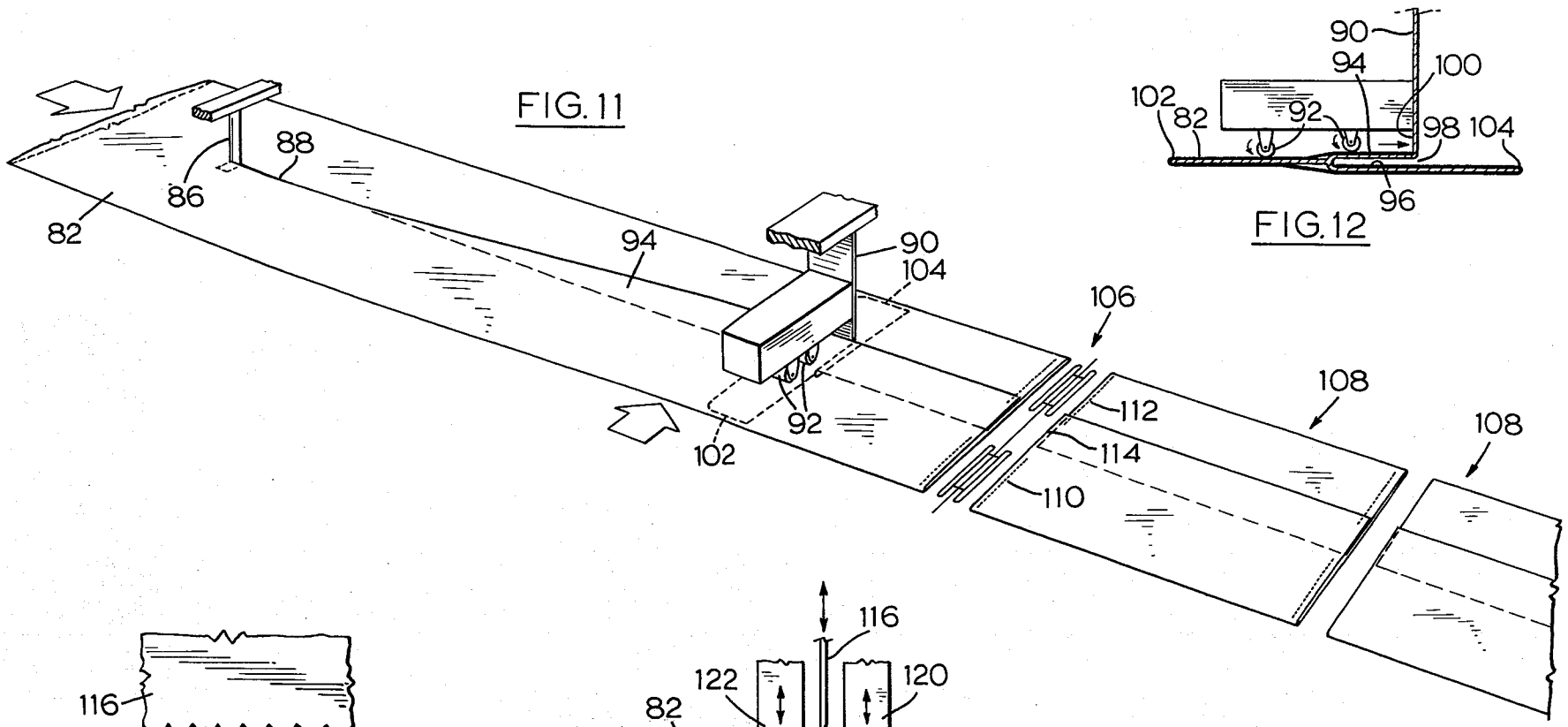
FIG. 11 is a schematic showing a preferred manner in which the bag portion of the suit bag of FIG. 1 is formed.
FIG. 12 is a cross-sectional view along lines 12—12 of the device shown in FIG. 11.
FIG. 13 is an enlarged view of the cutting and heat welding device.
FIG. 14 is an enlarged view of a portion of the knife used to transversely cut the bag material.

With the preferred embodiment shown in FIG. 1 the suit bag comprises a bag portion 10, and two handles 12 and 14 to be secured at the bag's ends 13 and 15. The bag portion 10 is a plastic film of any of several suitable plastics, preferred plastics being low density polyethylene, high density polyethylene, or a combination of polyethylene and vinyl. The inner surface 16 of the bag is provided with an opening or slit 20 which provides the sole means of entry into the bag after it is assembled. The inner surface 16 comprises two sections 17 and 19, the edges 18 and 22 of the slit or opening 20 defining the degree of overlap of the two inner bag sections 17 and 19. The degree of overlap may vary where the preferred range of overlap is from approximately 4 to 6 inches.

Each of the handles 12 and 14 are identical and comprise a hand grip portion 24, a bar portion 26 integrally molded with the hand grip portion and an eye and double hook portion 28 integrally molded on the edge of the bar 26 opposite the hand grip portion. When the bag is assembled, the bar portion 26 of the handles 12 and 14 are inserted within the bag in the direction of arrows 30 and 32.

Turning to FIG. 2, the bar portion 26 as shown by arrow 32 is inserted in between opposing internal surfaces 34 and 36 of the bag. As shown in FIG. 3, the bar portion 26 is thermally welded according to standard procedure to the opposing internal surfaces 34 and 36 in order to secure the handle to the bag. The heat-welds are shown at 38.

To facilitate insertion of the bar portion within the bag, the bag portion may be tacked, spot-welded or bar-welded in the areas indicated by dotted lines 40 shown in FIG. 1. The completed weld is shown in FIG. 2. The overlapped sections 17 and 19 of the inner surface 16 are welded together so that they are held in place during insertion of the bar portion 26 into the bag. The central portion of the bag is left open to provide a space through which the hook and eye portion 28 extends into the bag. After the bar welds 40 are completed, a light flow of air may be directed at the end of the bag to spread the internal surfaces 34 and 36. The bar portion 26 is then easily inserted within the bag and thermally welded at 38 by a bar weld as shown in FIG. 3 or welded by a sonic weld.

Referring to FIG. 4, with the enlarged view of the handle, it can be seen that the hand grip portion 24 has cutouts 42 and 44 which permit insertion of the fingers. A reinforcing bar 46 is provided to reinforce the upper portion 48 of the handle. The bar portion 26 of the handle has cross-hatching 50 to facilitate thermal welding of the plastic film to each side of the bar portion 26. The eye and hook portion 28 comprises an aperture 52 with a double-ended hook 54, the purpose of which will be described later.

Fastening means for detachably securing the handles in face-to-face relationship are provided on the handle along the upper edge of the bar 26. The fastening means comprise a plurality of projections 56 which are received by recesses 58. As previously noted, the handles are identical so that when one handle is turned end for end in the manner shown in FIG. 1, the apertures 58 of one handle are in register with and adapted to receive projections 56 of the other handle when the handles are brought together. The projections have knobs 59 so that the fastening means are snap-locked together to retain the handles in face-to-face relationship with the hand grip portions 24 aligned. The hand grip portion 24 has an aperture 60 provided therein to receive a projection 62 and snap-lock fit a hook 64 to the hand grip portion. This hook 64 may be secured to either handle 12 or 14 of the suit bag of FIG. 1.

The bar portion 26 of the handle is about the same width as that of the bag end so that when the handle is secured to the end of the bag, the end of the bag is essentially closed off. The only means of entry into the bag is through opening 20. It is understood, however, that the bar portion 26 need not extend fully across the end of the bag and for that matter, as long as it extends across a major portion of the bag to provide the necessary support at the bag ends when the loaded bag is being carried, the remainder of the bag end may be left open or sealed by a bar weld such as bar weld 40.

With the assembled bag in hand, the bag is easily loaded with a suit. The hook 64 is hooked onto any appropriate rack so that the bag is in the vertical plane. A suit which is placed on a hanger is inserted into the bag by spreading apart opening 20, placing the hook of the hanger through aperture 52 and bringing the inner edge 22 of the opening out over the suit to fully enclose the suit within the bag. The handles 12 and 14 are snap-locked together with the bag fold centrally of its length ready for carrying. The suit as it is folded within the bag is folded naturally so that when the suit is withdrawn from the bag, the natural folds fall out of the suit when the suit is hung. It is understood that other types of suit hanging devices may be provided on the handle such as one or more spring clips fastened along the inner edge of bar portion 26 to provide adequate means for hanging suits by.

An alternative method for placing and holding a suit within the bag is shown in FIGS. 8, 9, and 10 when it is desired not to use a hanger. The suit bag 10 is placed on a horizontal substantially flat surface. The suit 66 as shown in dotted lines is placed within the bag with a hanger tab 68 of a suit hooked onto the double-ended hook 54 of the handle. With the suit smoothed out and the bag retained on the flat surface, the handles are brought together as shown in FIG. 9 to fold the bag centrally of its length with the inside surface 16 of the bag being folded upon itself, as shown by the back of the suit 70. Once the handles are fastened together, the suit bag may be carried by the handle in the manner shown in FIG. 10 where the suit 66 retains its position in the bag. Although it is not fully understood why the suit retains its position in the bag, it is believed that the static electricity in the plastic bag film causes the suit to cling to the internal surfaces of the bag so that the shoulders of the suit do not sag. As soon as the bag is opened again and held in the vertical position, the shoulders will drop to facilitate removal of the suit from the suit bag. Suit pants and the like may also be hung by the belt loop from hook 54 in a similar manner.

Depending upon whether a person is right- or left-handed and wishes to load the suit into the bag from either direction, the hook 64 can be placed at either handle 12 or 14 so that when the bag is hung, the opening 20 is on the appropriate side for the left- or right-handed person. The interchangeability of the hook 64 with the handles 12 and 14 also prolongs the life of the bag whereby if one of the handle portions 28 wears out, then the other hanger 28 may be used on the other handle by interchanging the hook with the other handle. The hook 64 also permits use of the suit bag at home in a clothes closet or in an airplane where the folded suit bag is compact, easily stored and carried like an attache case.

An alternate embodiment of the invention is shown in FIG. 4 where edge 65 of the suit bag 67 has a closure device 72 which closes an opening along the bag edge 65. The closure device is provided to seal the bag to protect its contents from inclement weather or from high humidity during storage of its contents.

Although various types of closure devices are used, the type shown in FIG. 6 comprises a male portion 76 interlocked with a corresponding female portion 78. The male portion is integrally molded with the inside surface of inner bag section 69 and the female portion is integrally molded with the inside surface of outer bag section 63. Once a suit is placed within the bag through bag opening 80, the bag may be sealed by running the fingers along closure device 72 to interlock the male portion 76 in female portion 78 thereby closing bag opening 80. An example of such an interlocking device is found on plastic bags sold under the trade marks "MINIGRIP" or "ZIPLOC".

It should be understood that when it is desired to use a closure device, the opening may be provided on the outer surface of the bag because when the bag is folded with the opening closed, there is no chance of the goods within the bag falling out. On the other hand, when the opening is not closed, it is important that the opening be located on the inner surface 16 of the bag so that when the bag is folded and the inside surface folded upon itself the opening will not permit the goods within the bag to fall out of the bag.

The inner surface 16 of the bag may also be modified where the overlying section 17 of the bag on the inner surface is made wider and then folded back on itself and thermally welded at different locations to provide pockets on the inside surface of the bag. These pockets can then accept socks, shirts and the like when the suit bag is used on trips.

FIG. 7 shows an alternate arrangement of the handles for the suit bag of this invention. The bag portion 10 has a slit 71 on the inner surface 75 of the bag. A handle 73, identical to handle 12 of FIG. 1, is secured to each end of bag portion 10 (only one end of the bag is shown). The bar portion 77 of the handle is thermally welded to the inner surface 75 with the outer surface of the bag welded to the inner surface at the respective bag end. The bar portion 77 closes off a major portion of the respective end of the bag, however, the bag end may be entirely closed by use of a weld or other sealing means. The hook portion 79 of the handle is exterior of the bag's inner surface and centrally located of the bag's end. The slit 71 is in register with the hook portion 79. In loading this suit bag with a suit, the hook 81 of the suit hanger is passed through the hook portion 79 and the suit placed within the bag 10 through the slit 71. The edges of the slit are brought out over the suit 83 (shown in dotted lines) to leave only the hook portion 81 of the hanger exterior of the inner surface 75 of the bag. The handles, since they are identical to those of FIG. 1, are snap-locked together to fold the bag 10 centrally of its length where the inside surface 75 is folded onto itself so that the slit is on the inside of the fold to protect the suit from the elements.

Depending upon the end usage of the bag, that is, whether it is for a clothes retailer or for use as a trip bag, the thickness of the plastic film used would be selected accordingly. For most uses, 4 mil low density polyethylene or 2 mil high density polyethylene is acceptable. The sizes of the bag vary, depending upon the goods to be carried, such as men's and women's clothes. The bag size for a man's suit is approximately 24 by 40 inches.

Although there are several methods for making the bag according to this invention, a preferred method is shown schematically in FIG. 11 for making the bag portion 10 of FIG. 1. An extruded tube of polyethylene 82 is slit by a knife edge 86 to provide a slit 88. The slit material is conveyed along to a gathering device 90 where rollers 92 gather the overlying portion 94 of the film and place it over onto the underlying portion of the film. Turning to FIG. 12, the underlying portion 96 of the film is retained in slot 98 where rollers 92 gather the overlying portion 94 of the film and beat it against surface 100 of the device 90. The distance between edges 102 and 104 of the device govern the width of the suit bag. The distance between these edges may be adjustable to facilitate manufacture of various widths of bags. The overlapped film is transported to station 106 where the continuous length of film is cut into bag lengths 108 and the ends of the bags are bar-sealed at 110 and 112. It is important to note that the central portion 114 of the bag is not bar-sealed so as to permit insertion of the hook 28 of the handle within the bag. Referring to FIG. 13, station 106 is shown in enlarged view where a knife 116 severs the slit tube 82 as it is welded where the knife enters slot 118. The ends of the bag are simultaneously welded by bar welders 120 and 122 to produce bar welds 110 and 112.

Turning to FIG. 14, an enlarged section of knife 116 is shown where the knife is provided with saw-toothed edges 117 to facilitate cutting of the film into bag lengths 108.

The suit bag shown in FIG. 5 may be manufactured by extruding and blowing a tube of thin film of plastic with the male and female portions shown in FIG. 6 extruded integrally adjacent one another and on the exterior of the blown tube. The tube is slit between adjacent male and female portions to give a slit tube which is inverted so that the male and female portions are in register and are interlocked. The tube with interlocked male and female portions is then fed to a station such as that shown at 106 in FIG. 11 where the tube is cut into bag lengths 108 and bar-welded at the bag ends. The handles are welded to the bag ends in the manner shown in FIGS. 2 and 3.

The suit bag according to the several embodiments of this invention require a minimum of labour input and raw materials during manufacturing to give a product which costs substantially less to manufacture than the cost of manufacture of the common vinyl suit bag having a zippered opening.

Another feature of this suit bag is that the outer surface of the bag when folded provides two exterior surfaces on the bag to which advertising matter can be applied. As the consumer carries purchased goods in the folded suit bag, the place of purchase is clearly displayed on both bag outsides.

Although various preferred embodiments of the invention have been described herein in detail, it will be understood by those skilled in the art that modifications may be made thereto without departing from the spirit of the invention or the scope of the appended claims.

The embodiments of the invention in which an exclusive property or privilege is claimed are defined as follows:

1. A plastic suit bag comprising a bag portion of plastic film having rectangular shaped inner and outer surfaces with a handle secured at each end of the bag portion and having a slit in said inner surface extending between the bag ends to provide the sole means of entry into the suit bag, each handle being of plastic and having a hand grip portion integrally molded with a bar portion and having means for hanging a suit by provided on an edge of said bar portion opposite said hand grip portion, the bar portion being located between and thermally welded to opposing plastic film internal surfaces at each bag end with said means for hanging a suit by extending within the bag portion and said hand grip portion being exterior of the bag and centrally located of the bag's end, the bar portion extending along a major portion of the bag's end length to essentially close off each bag end, the two handles having fastening means exterior of the bag, which, when mated, secure the pair of handles together in face-to-face relationship with the hand grip portions aligned, the arrangement of the handles on the bag ends being such that as the handles are fastened together the outer and inner surfaces of the bag are folded centrally of their length with said inner surface folded onto itself.

2. A plastic suit bag of claim 1 wherein the plastic film of the inner surface of the bag portion is divided into two sections by said slit, one of said sections overlapping the other of said sections.

3. A plastic suit bag of claim 1 wherein a hook is adapted to be detachably secured to said hand grip portion of each said handle.

4. A plastic suit bag of claim 1 wherein said handles are identical.

5. A plastic suit bag of claim 1 wherein said fastening means comprises mating projections and recesses which are in register with one another when the inner surface of the bag is folded upon itself, the handles being secured together by snap-locking the projections in the respective recesses.

6. A plastic suit bag of claim 2 wherein the overlap of said inner surface is located off-centre of said means for hanging a suit by.

7. A plastic suit bag of claim 6 wherein said means for hanging a suit by comprises an eye portion with a hook integrally molded thereto.

8. A plastic suit bag of claim 6 wherein said plastic film is welded together in two locations inwardly of the innermost edge of said bar portion and spaced-apart from a central portion of the bag end to provide a centrally located space between the layers of the bag through which said means for hanging a suit by extends into said suit bag.

9. A plastic suit bag of claim 8 wherein one of said two locations of welding secures said overlapped sections in position.

10. A plastic suit bag of claim 9 wherein said sections overlap one another by at least four inches.

11. A plastic suit bag comprising a bag portion of plastic film having rectangular shaped inner and outer surfaces with a handle secured at each end of the bag portion, said bag portion having closure means for closing an opening which is provided in said bag portion and which extends between the ends of the bag, said opening providing the sole means of entry into the suit bag, each handle being of plastic and having a hand grip portion integrally molded with a bar portion and having means for hanging a suit by provided on an edge of said bar portion opposite said hand grip portion, the bar portion being located between and thermally welded to opposing plastic film internal surfaces at each bag end with said means for hanging a suit by extending within the bag portion and said hand grip portion being exterior of the bag and centrally located of the bag's end, the bar portion extending along a major portion of the bag's end length to essentially close off each bag end, the two handles having fastening means exterior of the bag and which when mated secure the pair of handles together in face-to-face relationship with the hand grip portions aligned, the arrangement being such that said closure means is used to close said opening prior to fastening said handles together in face-to-face relationship where the outer and inner surfaces of the bag are folded centrally of their length.

12. A plastic suit bag of claim 11 wherein said closure means and said opening are located proximate an edge which extends between the ends of said bag portion.

13. A plastic suit bag of claim 11 wherein said closure means and said opening are located along an edge which extends between the ends of said bag portion.

14. A plastic suit bag of claims 11 wherein said closure means is formed of plastic and comprises an interlocking male and female portion, said male portion being disposed along one edge of said opening and said female portion disposed along the other edge of said opening so that when the male and female portions are interlocked, the opening is closed with the edges of the opening offset from each other.

15. A plastic suit bag of claim 11 wherein a hook is adapted to be detachably secured to said hand grip portion of said handle.

16. A plastic suit bag of claim 11 wherein said handles are identical.

17. A plastic suit bag of claim 11 wherein said fastening means comprises mating projections and recesses which are in register with one another when the bag is folded upon itself with the handles secured together by snap-locking the projections in the respective recesses.

18. A plastic suit bag of claim 17 wherein said means for hanging a suit by comprises an eye portion with a hook integrally molded thereto.

19. A plastic suit bag of claim 17 wherein said plastic film is welded together in two locations inwardly of the innermost edge of said bar portion and spaced-apart from a central portion of a bag end to provide a centrally located space between the layers of the bag through which a single means for hanging a suit by extends into said suit bag.

20. A plastic suit bag comprising a bag portion of plastic film having rectangular shaped inner and outer surfaces with a handle secured at each end of the bag portion and having a centrally located slit in said inner surface extending between the bag ends to provide the sole means of entry into the suit bag, each handle being of plastic and having a hand grip portion integrally molded with a bar portion and having means for hanging a suit by provided on an edge of said bar portion opposite said hand grip portion, the bar portion being thermally welded to and externally of said inner and outer surfaces at a respective end of the bag portion with said hand grip portion exterior of and centrally located of the bag's end, the bar portion extending along a major portion of the bag's end length, said means for hanging a suit by being in register with said slit, the two handles having fastening means exterior of the bag, which, when mated, secure the pair of handles together in face-to-face relationship with the hand grip portions aligned, the arrangement of the handles on the bag ends being such that as the handles are fastened together, the outer and inner surfaces of the bag are folded centrally of their length with said inner surface folded onto itself.

* * * * *